United States Patent [19]

Prull

[11] 4,028,222

[45] June 7, 1977

[54] METHOD FOR EXTRACTING OIL FROM OIL SHALE

[76] Inventor: Phillip Earl Prull, 2100 Lewelling Blvd. No. 10, San Leandro, Calif. 94579

[22] Filed: Feb. 23, 1976

[21] Appl. No.: 660,060

[52] U.S. Cl. ..... 208/11 R

[51] Int. Cl.[2] ..... C10G 1/04

[58] Field of Search ..... 208/11 R; 201/7, 8, 201/26, 42

[56] References Cited

UNITED STATES PATENTS

| | | | |
|---|---|---|---|
| 2,911,349 | 11/1959 | Coulson | 208/11 R |
| 3,004,898 | 10/1961 | Deering | 208/11 R |
| 3,491,016 | 1/1970 | Gomory | 208/11 R |
| 3,499,834 | 3/1970 | Goins | 208/11 R |

*Primary Examiner*—Delbert E. Gantz

*Assistant Examiner*—James W. Hellwege

*Attorney, Agent, or Firm*—Schapp and Hatch

[57] ABSTRACT

A method for extraction of oil from oil shale in which the shale is first crushed and then classified by a rotating trammel screen into four separate portions of differing longest particle dimension, namely less than ¼ inch, less than ½ inch, less than ¾ inch and greater than ¾ inch, with the first three portions being treated while passing through the trammel screen and each portion then separately centrifuged under conditions of centrifuge speed, time and added heat optimal for shale particles of that size. The fourth portion is recrushed. The applied heat may be dry heat, dry steam or wet steam, and the temperature range lies between 200 degrees Farenheit and the flash point of the oil to be reextracted from the shale. Pressures ranging from atmospheric to slightly above atmospheric may be applied.

9 Claims, 2 Drawing Figures

FEED
CRUSH
12
13
17
18
19
21
CLASSIFY
HEATER
14
HEAT
16
CENT.
22
WASTE ROCK
PETROLEUM PRODUCTS
23
11

METHOD FOR EXTRACTING OIL FROM OIL SHALE

BACKGROUND OF THE INVENTION

This invention relates to a Method for Extracting Oil from Oil Shale, and more particularly to a heating, classifying and centrifuging process which maximizes the efficiency of such extraction.

The search for new energy resources has led to many efforts to extract hydrocarbons from materials previously considered uneconomic, such as tar sands and oil shales. The key to success in any such extraction technique lies in providing a maximum efficiency of energy use in the extraction process, per amount of hydrocarbon extracted.

The methods proposed in the prior art known to me have all tended to fail that criterion of maximum hydrocarbon yield for minimum energy input. In some methods, hydrocarbon yield was increased by crushing the oil shale to an extremely fine powder, necessitating a large energy consumption in the crushing process. Other methods relied on very high temperatures for greater extraction, again requiring a heavy input energy "debt". Still other methods have required complex and expensive processing equipment, such as closed-retort systems.

SUMMARY OF THE INVENTION

The extraction method of the present invention allows increased efficiency of extraction, with a lowered input energy burden by classifying the crushed shale according to particle size. The differing portions may then be subjected to individualized centrifuging programs aimed at maximizing extraction from that particular particle size. Excessive energy use in crushing all of the shale to a uniform and small particle size is thus avoided.

The input energy required is also held to a minimum by the individual centrifuging of the different classified portions since the time and speed of centrifuging can be concentrated on those portions most needing it. Furthermore, additional heat can be applied only to portions requiring it for fullest extraction, rather than to the entire bulk of crushed shale. Concentration of the input mechanical and heat energy only on those portions of the shale particles most needful of it for full extraction yields a substantial increase in petroleum product yield at an accompanying saving of the energy not wasted on particle sizes not requiring such treatment.

Accordingly, it is a principal object of the present invention to provide a method for extracting oil from shale which maximizes the efficiency of such extraction.

A further principal object of the present invention is to provide a method for extracting oil from shale which conserves input energy required.

Another principal object of the present invention is to provide a method for extracting oil from shale allowing use of separate centrifuging routines for oil shale particles of different sizes.

Still another object of the present invention is to provide a method for extracting oil from shale having simultaneous heating and classification of the crushed oil shale particles according to size.

A still further object of the present invention is to provide a method for extracting oil from shale permitting a wide selection of types of heat application to the crushed shale.

Further objects and advantages of the present invention will become apparent as the specification proceeds, and the new and useful features thereof will be fully defined in the claims attached hereto.

BRIEF DESCRIPTION OF THE DRAWINGS

The preferred forms of the present invention are illustrated in the accompanying drawings, forming part of this specification, in which.

Figures 1, 2:
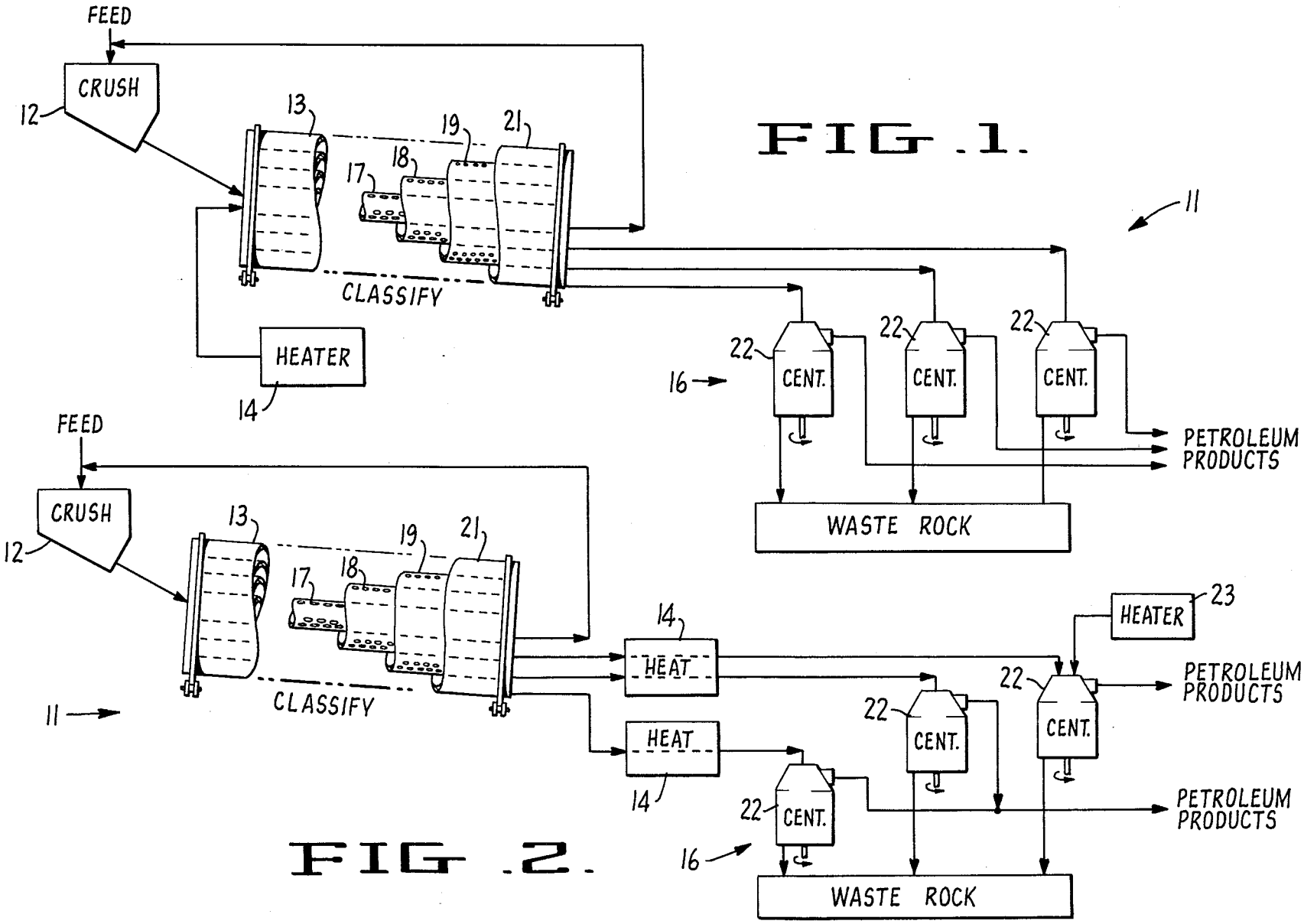
FIG. 1 is a block diagram showing the sequence of steps of the method of the present invention.
FIG. 2 is a block diagram of a modified embodiment of the method of the present invention.

While only the preferred forms of the present invention have been shown here, it should be understood that various changes or modifications may be made within the scope of the claims attached hereto without departing from the spirit of the invention.

DESCRIPTION OF THE PREFERRED EMBODIMENTS

Referring to the drawings in detail, it may be seen that the process for extraction of oil from oil shale and the like of the present invention is generally indicated by the arrow 11, and includes the step of crushing the oil shale, as in a crusher, as schematically indicated at 12. The process 11 further includes the step of classifying the crushed oil shale by particle size into at least two portions of differing range of particle sizes, as schematically indicated at 13, where a classifying means is diagrammatically indicated. The crushed oil shale is also heated, as symbolically shown at 14, to a temperature sufficient to release the oil therefrom and below the flash point of the oil released.

The crushed, classified and heated oil shale is then centrifuged, as indicated schematically at 16, each portion being separately centrifuged at a centrifuge speed and for a time selected for the greatest efficiency of oil extraction per unit of driving energy applied to the centrifuge. In the embodiment shown in FIG. 1, the steps of classifying and of heating the crushed oil shale are carried out simultaneously by application of heat to the crushed oil shale as it passes through the classifying means 13.

Preferably, the crushed oil shale is classified into four portions of differing range of particle size, the portion having the largest particle size being recrushed and reclassified. The three remaining portions are then subjected to the separate centrifuging. Ideally, the first of the portions, that having the smallest particle size, would be approximately that passing a ¼-inch mesh screen while the second of the portions would be that not passing a ¼-inch mesh screen but passing a ½-inch mesh screen. The third portion would be that passing a ¾-inch mesh screen and not passing a ½-inch mesh screen. The fourth portion, the one to be recrushed, would be that not passing a ¾-inch mesh screen.

Heat may be applied to the oil shale for extraction of the oil therefrom by dry heat, dry steam or wet steam, and may be carried out at or somewhat above atmospheric pressure. The upper limit of temperature would be the flash point of the extracted petroleum products, and the lower limit for practical extraction seems to be about 200° Fahrenheit. The choice of level of temperature, to which the crushed oil shale is heated, may also be optimized for the greatest effectiveness and efficiency of extraction per unit input energy.

The classification step may be carried out by a rotating trammel screen as schematically indicated at 13 in FIG. 1. In such a screen, the material to be classified is fed axially into the center member of a series of rotating, concentric, perforated drums. The inner drum has perforations in its circumference, sized here to pass particles of average dimensions, ¾ inch and below. The next outer drum has perforations sized to particles of average dimension, ½ inch and below, and the third drum radially outward of the axis has perforations sized to pass particles of average dimension, ¼ inch and below. The outermost drum has no perforations.

In a manner well understood for trammel screen-grading devices, the entire drum apparatus is slightly tilted from the horizontal so that the oil shale tumbles from the higher end toward the lower as the drum rotates. The material retained by each drum then exits separately at the low end to an appropriate conveyor (not shown). Heat may be applied to the interior of the trammel screen 13 by appropriate conduits (not shown) conducting hot gases, dry or wet steam to the space within the drums 17, 18, 19 and 21 for release there.

The classified oil shale particles are then conveyed to a bank of centrifuges 22, where each separate batch of particle sizes may be separately centrifuged for a longer or shorter time, at a higher or lower centrifuge rotation rate, according to the most energy-efficient program of extraction of the oil therefrom. The centrifuges 22 are preferably of the continuous-feed type. If needed, as indicated symbolically at 23 in FIG. 2, additional heat may be applied to any of the classified portions of crush oil shale during the centrifuging step, but energy will be conserved by applying the heat only to that range of particle sizes requiring additional heat. The additional heat may be applied by any of the techniques discussed above in connection with heating in the classification step.

Also as shown in FIG. 2, the heating step may be carried out independently of the classifying step for any or all portions of the crushed oil shale, and the additional heat for any one or more portions may be applied in a separate step before centrifuging that portion, rather than in the centrifuge 22. The petroleum products may be taken off the centrifuges separately and kept separate, as indicated in FIG. 1, or one or more of them may be combined as indicated in FIG. 2.

From the foregoing, it may be seen that a method for oil extraction from oil shale has been provided which maximizes the efficiency of extraction and conserves the input energy required by providing separate centrifuging routines for each group of oil shale particle sizes. The method also contemplates both simultaneous heating and classification and separate additional heat after classification for those particle sizes requiring it, and the method is adaptable to several types of heat application.

What is claimed is:

1. A process for extraction of oil from oil shale comprising crushing said oil shale;

classifying said crushed oil shale by particle size into at least two portions of differing range of particle size;

heating said oil shale to a temperature sufficient to release oil therefrom and below the flash point of the oil released therefrom; and separately centrifuging each of said portions to remove liquid oil therefrom at a centrifuge speed and for a length of time selected for maximal efficiency of oil separation from said portion per unit of driving energy input to said centrifuge.

2. A process for extraction of oil from oil shale as described in claim 1 and wherein said steps of classifying said crushed oil shale and heating said crushed oil shale are carried out substantially simultaneously.

3. A process for extraction of oil from oil shale as described in claim 1 and wherein said crushed oil shale is classified into at least four portions, one of said portions being of particle size approximately that passing a ¼-inch mesh screen, a second of said portions being of particle size approximately that passing a ½-inch mesh screen and not passing a ¼-inch mesh screen, a third of said portions being of particle size approximately that passing a ¾-inch mesh screen and not passing a ½-inch mesh screen, and the fourth of said portions being of particle size approximately that not passing a ¾-inch mesh screen, said fourth portion being recrushed and reclassified.

4. A process for extraction of oil from oil shale as described in claim 1 and wherein said step of heating said crushed oil shale is carried out by application of dry heat.

5. A process for extraction of oil from oil shale as described in claim 1 and wherein said step of heating said crushed oil shale is carried out by application of dry steam.

6. A process for extraction of oil from oil shale as described in claim 1 and wherein said step of heating said crushed oil shale is carried out by application of wet steam.

7. A process for extraction of oil from oil shale as described in claim 1 and wherein said step of heating said crushed oil shale is carried out at a temperature in excess of 200° Fahrenheit.

8. A process for extraction of oil from oil shale as described in claim 2 and wherein said step of classifying said crushed oil shale is carried out by a rotating trammel screen.

9. A process for extraction of oil from oil shale as described in claim 3 and wherein said steps of classifying said crushed oil shale and heating said crushed oil shale are carried out substantially simultaneously, and said step of heating said crushed oil shale is carried out by application of dry heat, said crushed oil shale being heated to a temperature in excess of 200° Fahrenheit.

* * * * *